US009061326B2

(12) United States Patent
Eriksson et al.

(10) Patent No.: US 9,061,326 B2
(45) Date of Patent: Jun. 23, 2015

(54) SYSTEM, TOOL AND METHOD FOR CLEANING THE INTERIOR OF A FREIGHT CONTAINER

(75) Inventors: Kerstin Eriksson, Eskilstuna (SE); Erik Jansson, Eskilstuna (SE); Anders Thunell, Uppsala (SE); Ingemar Reyier, Vasteras (SE)

(73) Assignee: IBC ROBOTICS AB (SE)

( * ) Notice: Subject to any disclaimer, the term of this patent is extended or adjusted under 35 U.S.C. 154(b) by 331 days.

(21) Appl. No.: 13/322,824

(22) PCT Filed: May 5, 2010

(86) PCT No.: PCT/EP2010/056060

§ 371 (c)(1),
(2), (4) Date: Jan. 4, 2012

(87) PCT Pub. No.: WO2010/136305

PCT Pub. Date: Dec. 2, 2010

(65) Prior Publication Data

US 2012/0273009 A1 Nov. 1, 2012

(30) Foreign Application Priority Data

May 26, 2009 (EP) ..... 09161108

(51) Int. Cl.

| | |
|---|---|
| ***B24C 1/00*** | (2006.01) |
| ***B08B 9/08*** | (2006.01) |
| ***B08B 9/093*** | (2006.01) |
| ***B24C 3/32*** | (2006.01) |

(52) U.S. Cl.

CPC . *B08B 9/08* (2013.01); *B08B 9/093* (2013.01); *B24C 1/003* (2013.01); *B24C 3/325* (2013.01)

(58) Field of Classification Search

CPC .... B24B 45/006; B23C 5/2243; B24D 7/066; B27G 13/10; B28D 1/188; B24C 1/003; B24C 3/16; B24C 3/327

USPC ..... 451/76, 38, 39, 40

See application file for complete search history.

(56) References Cited

U.S. PATENT DOCUMENTS 3,461,889 A * 8/1969 Saxonmeyer ..... 134/43
3,534,746 A * 10/1970 Posner ..... 134/46

(Continued)

FOREIGN PATENT DOCUMENTS

CH 698563 A2 8/2009
GB 1404342 A 8/1975

(Continued)

OTHER PUBLICATIONS

International Search Report for PCT/EP2010/056060, Completed by the European Patent Office on Jun. 25, 2010, 4 Pages.

*Primary Examiner* — Maurina Rachuba
(74) *Attorney, Agent, or Firm* — Brooks Kushman P.C.

(57) ABSTRACT

A tool and method for cleaning the interior of a freight container of ISO type. The tool having a framework, a robot movably connected to the framework and provided with a nozzle for supplying dry ice. The robot and the nozzle are adapted to clean the interior of the container by means of dry ice blasting. An actuating unit is arranged to move the robot between the framework and the interior of the container. The tool is a portable unit and has a size and a design that allows a truck adapted for gripping and carrying freight containers of ISO type to grip and carry the tool in order to move the tool to and from the container to be cleaned.

11 Claims, 5 Drawing Sheets

(56) References Cited

U.S. PATENT DOCUMENTS

| | | | | | |
|---|---|---|---|---|---|
| 3,830,430 | A | * | 8/1974 | Hartunian | 239/752 |
| 3,897,263 | A | * | 7/1975 | Davis et al. | 134/45 |
| 3,961,983 | A | * | 6/1976 | Crandall et al. | 134/8 |
| 4,106,516 | A | * | 8/1978 | Wiegand | 134/45 |
| 4,112,533 | A | * | 9/1978 | Brager | 15/53.2 |
| 4,141,374 | A | * | 2/1979 | McMahan | 134/46 |
| 4,240,175 | A | * | 12/1980 | Rogers | 15/88.4 |
| 4,817,653 | A | * | 4/1989 | Krajicek et al. | 134/168 R |
| 5,624,745 | A | | 4/1997 | Lapidus | |
| 5,642,745 | A | * | 7/1997 | Landry et al. | 134/167 R |
| 6,279,589 | B1 | * | 8/2001 | Goodley | 134/102.1 |
| 6,517,639 | B2 | * | 2/2003 | Toepfer et al. | 134/21 |
| 8,834,609 | B2 | * | 9/2014 | Joh et al. | 95/165 |
| 2006/0089090 | A1 | * | 4/2006 | Johnson et al. | 451/40 |
| 2007/0037484 | A1 | * | 2/2007 | Ohishi et al. | 451/5 |

FOREIGN PATENT DOCUMENTS

| | | | |
|---|---|---|---|
| WO | 9639277 | A2 | 12/1996 |
| WO | 2007027111 | A1 | 3/2007 |

* cited by examiner

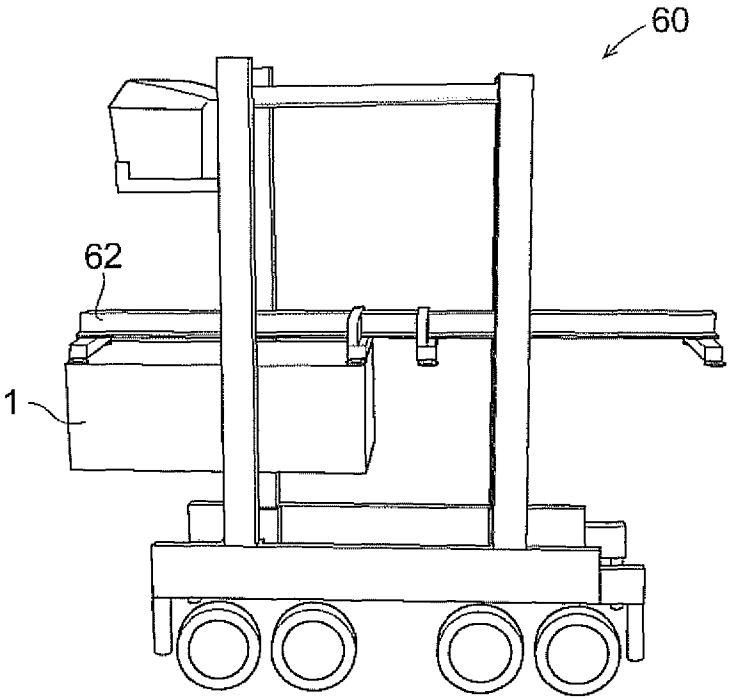
Fig. 6
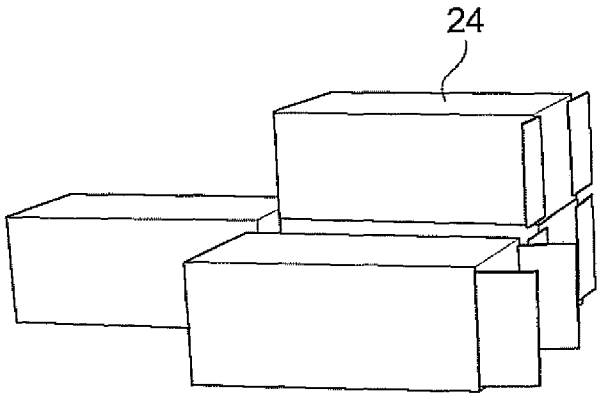

SYSTEM, TOOL AND METHOD FOR CLEANING THE INTERIOR OF A FREIGHT CONTAINER

CROSS-REFERENCE TO RELATED APPLICATION

This application is the U.S. national phase of PCT Appln. No. PCT/EP2010/056060 filed May 5, 2010 which claims priority to European application 09161108.7 filed May 26, 2009, the disclosures of which are incorporated in their entirety by reference herein.

FIELD OF THE INVENTION

The present invention relates to a system and a tool for cleaning the interior of a freight container of ISO type. The present invention also relates to a method for cleaning the interior of a freight container of ISO type.

PRIOR ART

ISO containers, also called shipping containers or intermodal containers, are used for intermodal transport of freight. They are manufactured according to specifications from the International Standards Organization (ISO) and are suitable for multiple transportation methods such as truck, rail, and ship. ISO containers are manufactured in many sizes. Standard containers are 8 ft. wide and 6 in. tall. The most common lengths are 20 and 40 ft. Other lengths include 24, 28, 44, 45, 46, 53 and 56 ft. There are several basic types of ISO containers. The sizes of the ISO containers are selected so that they are within load profiles that exist for railway and road transport systems.

After usage the containers has to be cleaned. This is often done in a certain place, for example, a harbor or a logistic centre. A large number of containers are handled in the same place. For facilitating the transportation of the containers, for example, between the transport means, such as ship, trains or lorries and the cleaning station, specially designed trucks have been developed for picking up and moving ISO containers.

Traditionally, the cleaning of the containers is made by using a solvent in combination with high pressure wash. This means that the waste water produced during the cleaning is contaminated with the solvent as well as the dirt removed from the container. A disadvantage with this cleaning method is that it produces a large amount of waste water which has to be collected and purified in order to avoid negative environmental influence. The cost for building a plant for collecting and purifying the waste water is extensive. A further disadvantage with this cleaning method is that it takes a long time for the container to dry after the cleaning has been finished.

The cleaning of the ISO containers is usually carried out by humans operating a high-pressure wash by hand. However, from U.S. Pat. No. 5,624,745 is known to use a robot for cleaning large storage tanks having a small access opening, such as are in commonly used in petrochemical plants or in oil refineries. The robot is provided with an articulated nozzle for supplying a cleaning medium including water and a diluent, such as diesel fuel. The robot is enclosed in a chamber having an opening sized and adapted to attach to the access opening of the container. An actuating unit is arranged to move the robot between the chamber and the interior of the container.

A well known cleaning method from other areas is dry ice blasting, also known as CO2 ice blasting. Dry ice blasting uses compressed air to accelerate frozen carbon dioxide (CO2) "dry ice" pellets to a high velocity. The dry ice pellets are accelerated at supersonic speeds, and creates mini-explosions on the surface to lift the undesirable item off the underlying substrate. The dry ice blasting technique has many advantages, for example, it is environmentally-friendly and contains no secondary contaminants such as solvents or grit media, it is clean and approved for use in the food industry, and can be used without damaging active electrical or mechanical parts or creating fire hazards.

WO9639277 discloses a method for removing explosives deposits in effluent pipes or from ammunitions casings. The explosive is removed from the wall of the pipe with the aid of dry ice blasting. A robot carrying a nozzle is used for providing the dry ice to the walls of the pipe.

OBJECTS AND SUMMARY OF THE INVENTION

The object of the present invention is to improve cleaning of containers of ISO type in order to reduce costs and provide a more environmental friendly cleaning.

According to one aspect of the invention, this object is achieved by providing a tool as defined in claim 1.

Such a tool comprises a framework, a robot movably connected to the framework and provided with a nozzle for supplying a cleaning medium, and an actuating unit arranged to move the robot between the framework and the interior of the container, and is characterized in that the tool is a portable unit, the tool has a size and design that allows a truck adapted for gripping and carrying freight containers of ISO type to grip and carry the tool in order to move the tool to and from the container to be cleaned, said cleaning medium is dry ice, and the robot and the nozzle are adapted to clean the interior of the container by means of dry ice blasting. With dry ice is meant frozen carbon dioxide.

An advantage with using ice blasting is that no solvent is needed. A further advantage with ice blasting compared to using solvent in combination with high pressure wash, is that the amount of waste is extensively reduced, since the dry ice will vaporize after it has been used. Further advantages with ice blasting are that no time for drying is needed, and that it is disinfecting. According to the invention the cleaning is automatically carried out by a robot, which is cost saving. There are often many containers to be cleaned, so either the containers have to be moved to the cleaning tool, or the cleaning tool has to be moved to the containers. A robot is heavy and accordingly the tool is difficult to move by hand. According to the invention, the tool is designed to allow a truck adapted for gripping and carrying freight containers of ISO type to grip and carry the tool. This is advantageous since the same truck that is used for moving the containers can be used to move the cleaning tool, which means that existing investments can be utilized. Moving the containers to the cleaning tool may cause logistic problems. With a tool according to the invention it is possible for the user to select if the containers are to be moved to the cleaning tool, or if the cleaning tool is to be moved to the containers to be cleaned. A further advantage is that the tool does not need to be equipped with means for moving the tool. This is also cost saving.

According to an embodiment of the invention, the framework comprises a housing enclosing the robot and the actuating unit, the housing having an opening for receiving the robot and the actuating unit is arranged to move the robot between the interior of the housing and the interior of the container when the opening of the housing is facing the opening of the container. The cleaning of the containers is usually carried out outdoor. In this embodiment the robot is protected from damp, dust and sand from the surrounding environment and accordingly can be used outdoors in difficult environments.

According to an embodiment of the invention, the housing is sized and designed as an ISO-container. A typical ISO-container has an elongated housing with a rectangular cross section, and the opening of the container is provided in one of the short sides of the housing. Preferably, the housing is made of an ISO-container. By placing the robot and the actuator in an ISO-container, or in a housing sized and designed as an ISO-container, the robot is protected from damp and dust from the environment, suitable environmental conditions for the robot regarding temperature and humidity can be achieved, and the tool can be handled and moved by a traditional truck designed for moving ISO-containers. A further advantage is that it is possible to transport the tool with existing sea, rail and road transport systems adapted to transportation of ISO containers. A further advantage is that it is cheaper to buy an ISO container and use it as housing, instead of designing and producing a specially designed housing for the cleaning tool.

According to an embodiment of the invention, the opening of the housing is sized to attach to the access opening of the container, and the tool comprises means for attaching the opening of the housing to the opening of container. A typical ISO-container has of an access opening with a rectangular cross section. This embodiment enables sealing attachment between the container and the tool in order to prevent hazardous waste from leaking to the environment during the cleaning.

According to an embodiment of the invention, the opening of the housing is provided with a door and the housing is designed to sealingly enclose the robot when the door is closed in order to protect the robot from the surrounding environment and to achieve suitable environmental conditions for the robot, such as suitable temperature and humidity.

According to an embodiment of the invention, the tool comprises a dry ice producing unit arranged to produce dry ice and to provide the nozzle with the dry ice, and the dry ice producing unit is located inside the housing. Dry ice vaporizes quickly although properly cooled and accordingly can not be stored more than about 24 hours. According to this embodiment, the tool is provided with necessary equipment for producing the dry ice instantly needed for the cleaning. Thus, no dry ice has to be stored. This tool is not dependent on delivery of dry ice from outside. An advantage with this embodiment is that the tool becomes autonomous.

According to an embodiment of the invention, the tool comprises a power unit for providing power to the robot, the actuating unit and to the dry ice producing unit, and the power unit is located inside the housing. This tool is not dependent on power delivered through a cable from outside the tool. An advantage with this embodiment is that the tool becomes autonomous and easy to move since no cable has to be connected between the tool and a remotely located power source.

According to an embodiment of the invention, said power unit is arranged to produce power based on fossil fuel, such as diesel, and the dry ice producing unit is configured to receive the waste gases from the power unit and reuse the carbon dioxide of the waste gases for producing the dry ice. This embodiment is environmentally friendly as the $CO_2$ from the waste gases of the power producing unit is reused for producing the dry ice.

According to an embodiment of the invention, the tool comprises a ventilation duct for transporting waste products originating from the dry ice cleaning from the container to the tool, the ventilation duct having an inlet end arranged in the opening of the housing and the duct is located inside the housing. The waste product from the cleaning is collected and transported to the tool which, for example, is provided with storage for storing the waste products. This is possible as the amount of waste products from the ice blast cleaning is small. This embodiment further increases the environmental friendliness.

According to an embodiment of the invention, the robot is a traditional industrial robot having at least four rotational axes. It is not necessary to have a specially designed robot, instead a common multi purpose industrial robot is used and programmed to carry out the ice blasting.

According to another aspect of the invention, this object is achieved by providing a method as defined in claim 13.

The method comprises providing a cleaning tool comprising a framework, a robot movable connected to the framework and having a nozzle for supplying a cleaning medium including dry ice, and an actuating unit arranged to move the robot relative the framework, gripping the framework of the tool by means of a truck designed for gripping and carrying freight containers of ISO type, driving the truck carrying the tool to the container to be cleaned, moving the robot into the interior of the container by means of the actuating unit, and moving the nozzle by means of the robot along a programmed cleaning path while cleaning the interior of the container by means of dry ice blasting.

According to an embodiment of the invention, the framework comprises a housing enclosing the robot and the actuating unit, the housing having an opening sized to attach to the access opening of the container, the truck is moving the tool to a position in which the opening of the housing is facing the opening of the container, and the method comprises attaching the opening of the housing to the opening of container.

According to another aspect of the invention, this object is achieved by providing a system for cleaning the interior of a freight container of ISO type as defined in claim 15.

The system comprising a cleaning tool including a framework, a robot movable connected to the framework and provided with a nozzle for supplying a cleaning medium, an actuating unit arranged to move the robot between the framework and the interior of the container. The cleaning medium contains dry ice and the robot is adapted to clean the interior of the container by means of dry ice blasting, the system further comprises a truck adapted for gripping and carrying freight containers of ISO type, the tool is portable unit, and the housing has a size and design that allows said truck to grip and carry the cleaning tool in order to move the cleaning tool to the container to be cleaned.

BRIEF DESCRIPTION OF THE DRAWINGS

The invention will now be explained more closely by the description of different embodiments of the invention and with reference to the appended figures.

FIG. 6 shows a truck moving the cleaning tool to the container to be cleaned.

DETAILED DESCRIPTION OF PREFERRED EMBODIMENTS OF THE INVENTION

Figure 1:
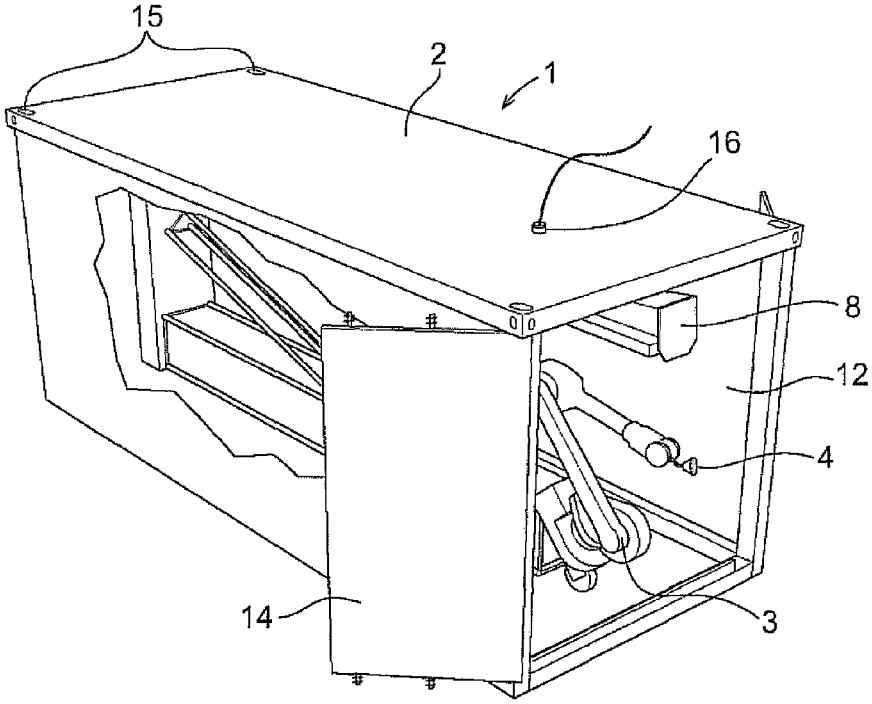
FIG. 1 shows a tool for cleaning the interior of a freight container according to an embodiment of the invention in a perspective view seen slightly from above.
Figure 2:
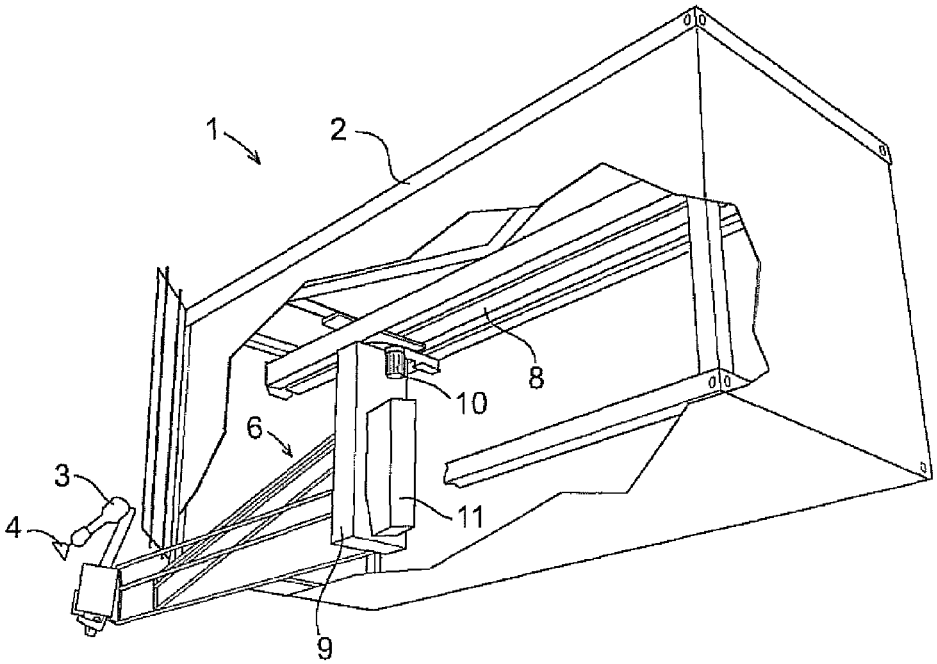
FIG. 2 shows a perspective view of the tool shown in FIG. 1 seen slightly from below.

FIGS. 1 and 2 shows a tool 1 for cleaning the interior of a freight container according to an embodiment of the invention. The tool 1 comprises a framework 2 having a size and design that allows a truck adapted for gripping and carrying freight containers of ISO-type to grip and carry the tool. Preferably, the external size of the framework should correspond to the outer size of an ISO-container. It is particular important that the width of the tool is not much larger than the width of an ISO-container. Further, the framework should be designed so that it is possible for the truck to grip the container with a standardized gripping tool. The tool further comprises a robot 3 movably connected to the framework 2 and provided with a nozzle 4 for spurting dry ice. The robot and the nozzle are adapted to clean the interior of the container by means of dry ice blasting.

In this example, the framework 2 is provided with a rail 8 arranged in the ceiling. Alternatively, the rail can be mounted on the floor of the framework. The tool also includes an actuating unit 6 arranged to move the robot between the interior of the framework and the interior of the container to be cleaned. In this example, the actuating unit 6 includes an elongated holding device 9 connected to the robot and arranged movable relative the beam 8. The actuating unit further includes a motor 10 for driving the motion of the robot relative the framework. The holding device 9 has a length that essentially corresponds to the length of the interior of the housing 2. This is advantageous since the length of the housing corresponds to the length of the container to be cleaned, and accordingly the robot can reach the inner part of the container during the cleaning. The holding device 9 is provided with a counter weight 11 to compensate for the weight of the robot. The holding device 9 carrying the robot 3 is arranged movable along the longitudinal axis of the housing 2.

In this example, the framework 2 is designed as an elongated housing enclosing the robot 3 and the actuating unit 6. The housing is provided with an opening 12 in one of its short ends and has a size such that the robot can be moved between the outside and the interior of the housing through the opening. The opening 12 is provided with a door 14. The door can be opened 270 degrees and accordingly allows a leak proof connection to the opening of the container. The housing is provided with means 15 for receiving grippers of a gripping tool of the truck, and for attaching the housing to the gripping tool. In this embodiment the means 15 is a set of three holes, each set of holes arranged in one corner of the roof of the housing. The gripping tool of the truck includes correspondingly arranged grippers with a hook. During the gripping, the hooks are inserted into the holed and the grippers are turned so that the hooks are locked in the holes. In this embodiment, the housing 2 is provided with an electrical connector 16 for connection to a power supply cable. The power is, for example, supplied from the truck to the tool. In this embodiment the housing is made of an ISO-container, for example, with a length of 20 ft or 40 ft. Such an ISO-container has a rectangular cross section and an opening with a rectangular cross section.

In this example the robot 3 is a traditional industrial robot having three main axes and three wrist axis. A stationary foot, usually referred to as the base of the robot, supports a stand which is rotatable about a first axis. The stand supports a first arm which is rotatable about a second axis. The first arm supports a sec- and arm which is rotatable about a third axis. The second arm supports a wrist which is rotatable about a fourth, fifth and a sixth axis. The wrist supports the nozzle 4. The movement of the robot 3 is controlled by robot controller. Preferably, the robot controller is located inside the housing 2. Preferably, the actuating unit 6, and accordingly the horizontal movements of the robot 3 relative housing 2 is also controlled by the robot controller.

Figure 3:
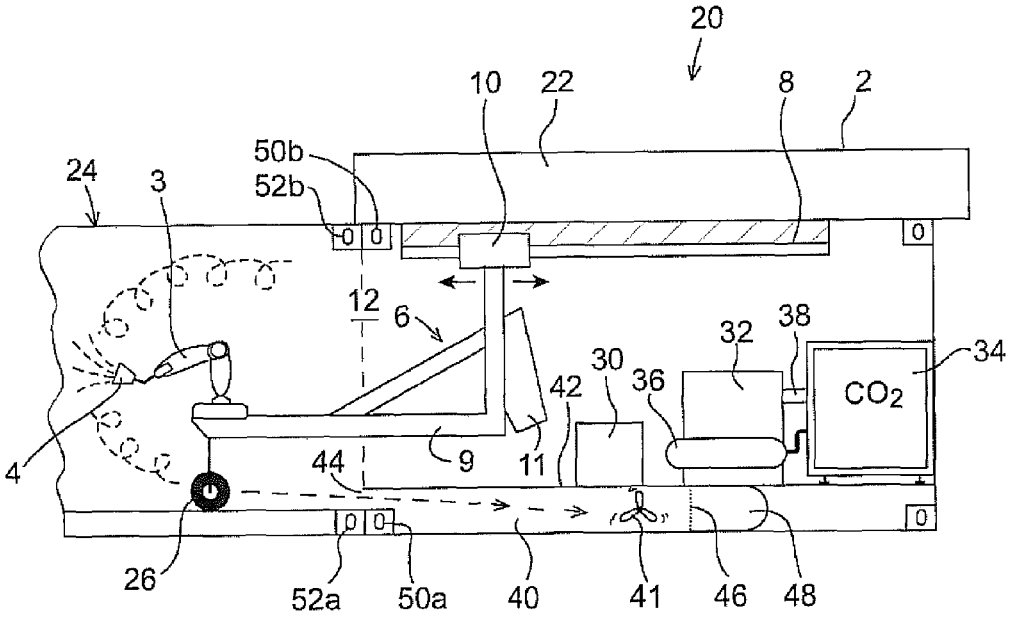
FIG. 3 shows a tool for cleaning the interior of a freight container according to another embodiment of the invention.

FIG. 3 shows a cleaning tool 20 according to another embodiment of the invention and a container 24 to be cleaned. Elements corresponding to the ones of the embodiment shown in FIGS. 1 and 2 are given in the same reference numbers as the corresponding elements of that embodiment. The tool 20 includes a robot 3 provided with a nozzle 4 adapted for dry ice blasting and a housing 2. The actuating unit 6 is arranged to move the robot 3 between the interior of the housing 2 and the interior of the container 24. FIG. 3 shows the robot in its cleaning position inside the container while cleaning the container by means of dry-ice blasting. In this embodiment, the holding device 9 is provided with a support wheel 26 for facilitating the movements of the robot between the container and the housing. However, it is also possible to have more than one support wheel.

The robot 3 is controlled by a robot controller 30 located inside the housing 2. The robot controller 30 is a traditional robot controller and includes software for controlling the movements of the robot and accordingly the movements of the nozzle 4. The roof 22 of the housing 2 is designed as an interface to a gripping device of a truck adapted for gripping and carrying ISO-containers. In this embodiment, the tool comprises a power unit 32 for providing power to the robot 3, the motor 10 of the actuating unit, and to a dry ice producing unit 34. The power unit 32 is located inside the housing 2. The power unit 32 is, for example, a battery, fuel cell, or a power plant producing electricity based on a fossil fuel. In this embodiment the power unit is a power plant producing electricity based on diesel.

In this embodiment, the tool further comprises a dry ice producing unit 34 arranged to produce dry ice, i.e. frozen carbon dioxide, and to provide the nozzle with the dry ice. The dry ice producing unit 34 is located inside the housing 2. The dry ice producing unit 34 comprises storage for $CO_2$. The dry ice producing unit further includes a compressor 36 for delivering the dry ice with super sonic speed to the walls of the container to be cleaned. In this example, the power unit 32 includes a diesel engine. The diesel engine produces waist gases including carbon dioxide. The carbon dioxide is separated from the waist gases and is led to the dry ice producing unit 34 via a duct 38. The dry ice producing unit is configured to receive the carbon dioxide from the power unit and to use the carbon dioxide for producing dry ice in addition to the stored $CO_2$. Accordingly, the $CO_2$ from diesel engine is reused in the dry ice producing unit.

The dry ice produced by the dry ice producing unit 34 is transferred to the nozzle 4 by means of a flexible tube (not shown). The electrical power produced by the power unit 32 is supplied to the robot controller 30, to the motor 10 of the actuating unit, the compressor 32 and to the dry ice producing unit 34. The robot controller 30 is connected to the robot 3 and provides the robot with power. Alternatively, it is possible to use prefabricated dry ice.

Figure 4:
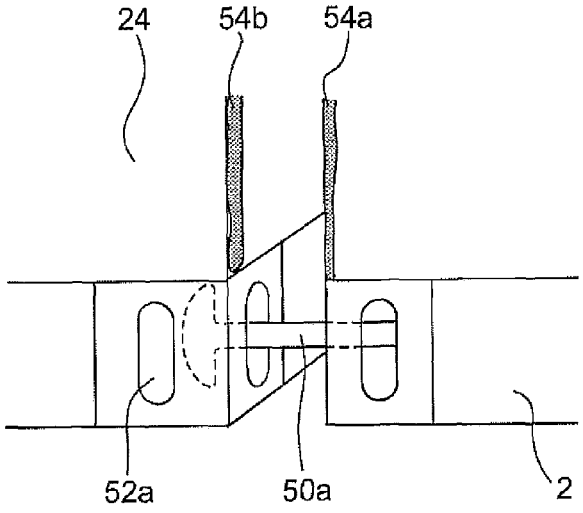
FIG. 4 shows an example of means for attaching the opening of the housing to the opening of container.

The tool further comprises a ventilation duct 40 provided with a fan 41 for transporting waist products, originating from the dry ice cleaning, from the container 24 to the tool 20. The ventilation duct 40 has an inlet 44 arranged in the opening 12 of the housing and an outlet 46. The outlet 46 is, for example, connected to a storage unit 48, such as removable bag, for retaining the waist products. The duct and the bag are located inside the housing. The duct 40 is, for example, arranged by installation of a second floor 42 in the housing of the tool. The opening of the container 24 as well as of the opening 12 of the housing 2 is provided with bellows 54*a-b* to allow the openings to be sealingly connected to each other. The tool comprises means 50*a-b* for attaching the opening of the housing 2 to the opening of the container 24. The container is provided with corresponding attachment means 52*a-b*. FIG. 4 shows an example of the attachment means in more detail. In this example the attachment means of the tool includes a rotatable gripping arm 50*a* arranged movable relative the housing of the tool, and the container 24 is provided with space having an elongated opening 52*a* adapted for receiving the rotatable gripping arm. This is a common type of attachment means for ISO-containers.

Figure 5:
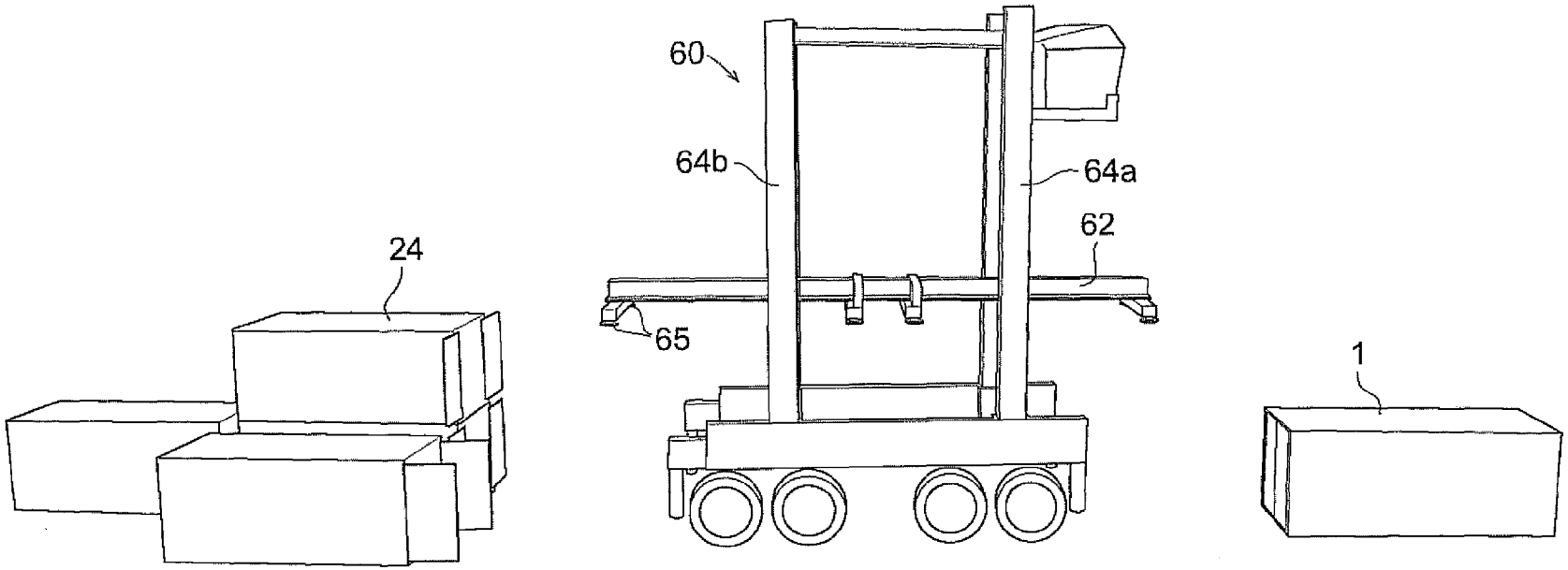
FIG. 5 shows a system for cleaning the interior of freight containers according to an embodiment of the invention.
Figure 7:
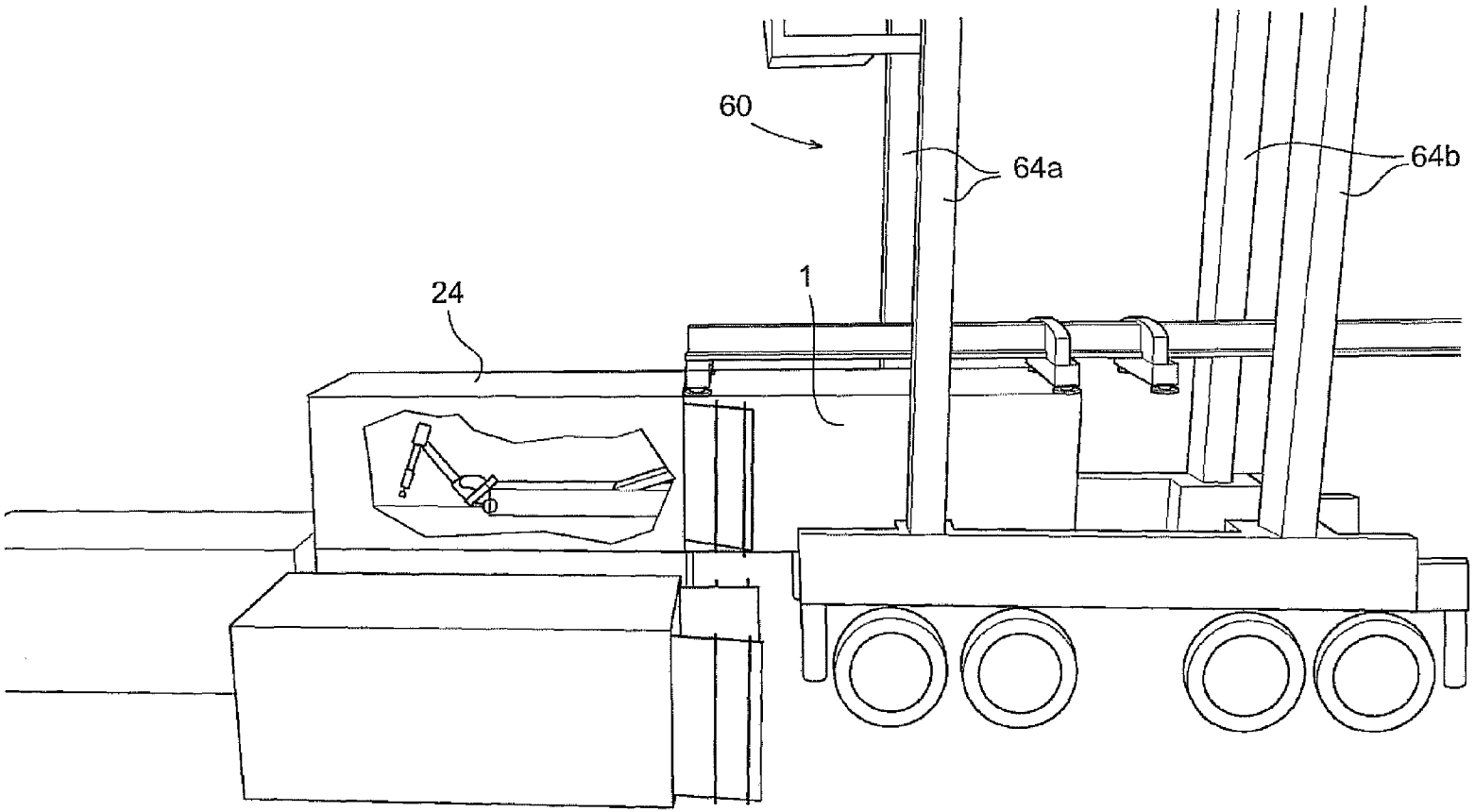
FIG. 7 shows the tool during cleaning of the container.

FIGS. 5-7 show a system for cleaning the interior of ISO-containers 24. The containers 24 have access openings for receiving goods. The system comprises a cleaning tool 20 as described with referenced to FIGS. 1 and 2. The system further comprises a truck 60 specially designed for gripping and carrying freight containers of ISO-type. The truck 60 includes a base structure provided with wheels and a motor. The base structure is provided with two pairs of upwardly protruding elements: a pair of front elements 64*a* and a pair of rear elements 64*b*. The distance between the elements of the pair correspond to, or is a little bit larger than the width of the containers in order to allow the front and rear elements 64*a-b* to receive the container 24. The truck is further provided with a gripping tool 62. The gripping tool 62 is arranged vertically movable relative the elements 64*a-b* and accordingly relative the ground. The gripper tool 62 is provided with at least four grippers 65 designed to grip and attach to the container 24. The grippers 65 are, for example, of the same type as shown in FIG. 4. The grippers 65 includes a rotatable gripping arm arranged movable relative the gripping tool, and the roof of the containers 24 and the housing 2 of the cleaning tool is provided with space having an elongated openings 15 adapted for receiving the rotatable gripping arm. This truck 60 is designed for gripping and moving ISO-containers 24. According to the invention, the same truck 60 is also used for gripping and transportation of the cleaning tool 1.

FIG. 5 shows the truck 60 moving towards the cleaning tool 1. When the truck has reached the cleaning tool, the gripping tool 62 is moved so that it is above the roof of the cleaning tool. The gripping tool is lowered until the gripping arms of grippers can be inserted into the openings 15 of the housing of the cleaning tool. When the gripping arms have been inserted in the openings, the gripping arms are rotated about 90 degrees and the grippers are locked. When the cleaning tool has been attached to gripping tool of the truck and raised from the ground, the truck moves the cleaning tool in a direction towards the container 24 to be cleaned, as shown in FIG. 6. The door of the container to be cleaned and the door of the housing of the cleaning tool are opened. The truck moves the cleaning tool so that the opening of the cleaning tool is facing the opening of the container 24. Thereafter, the truck moves the cleaning tool into contact with the container and the openings are attached to each other. The robot is moved by means of the actuating unit from the interior of the cleaning tool to the interior of the container 24. When the robot is inside the container 24 the robot begins the cleaning by dry ice blaster of the interior of the container, as shown in FIG. 7. The robot is moved according to a preprogrammed path suitable for carrying out cleaning of the interior of the container. During the cleaning, the actuating unit moves the robot along the length axes of the container so that the entire container is cleaned.

When the cleaning is finished the robot is moved back into the interior of the cleaning tool 20 and the truck 60 either moves the cleaning tool to the next container to be cleaned, or if all containers has been cleaned, moves the cleaning tool back to a storage position of the tool. When the cleaning of the containers has been finished the same truck can be used for moving the cleaned containers to a vehicle such as a train or a ship for further transportation.

The present invention is not limited to the embodiments disclosed but may be varied and modified within the scope of the following claims. For example, in the embodiments described above the housing is provided with walls enclosing the robot and thereby achieving suitable conditions for the robot regarding damp and temperature. In an alternative embodiment it is possible to have a framework without walls, or with only a few walls, or with only a roof, but no walls. However, such a construction is only suitable to use indoors. The truck disclosed in FIGS. 5-7 is a straddle carrier type of truck. However, the truck can be of various types, for example, container handlers, reach stackers, forklift trucks and automatic stacking cranes.

The invention claimed is:

1. A tool for cleaning an interior of a freight container of ISO type having an access opening for receiving goods, the tool comprising:

a framework;

a robot movably connected to the framework and provided with a nozzle for supplying a cleaning medium; and an actuating unit arranged to move the robot between the framework and the interior of the container, wherein:

the tool is a portable unit;

the tool has a size and design that allows a truck adapted for gripping and carrying freight containers of ISO type to grip and carry the tool in order to move the tool to and from the container to be cleaned;

said cleaning medium is dry ice; and the robot and the nozzle are adapted to clean the interior of the container by means of dry ice blasting, and wherein the framework comprises a housing enclosing the robot and the actuating unit, the housing having an opening for receiving the robot and the actuating unit is arranged to move the robot between an interior of the housing and the interior of the container when the opening of the housing is facing the opening of the container and wherein the housing further includes a ventilation duct for transporting waste products originating from the dry ice cleaning from the container to the tool, the ventilation duct having an inlet arranged in the opening of the housing.

2. The tool according to claim 1, wherein the housing is sized and designed as an ISO-container.

3. The tool according to claim 1, wherein the housing is elongated, the housing has a rectangular cross section, and the housing opening has a rectangular cross section and is provided in one of the short sides of the housing.

4. The tool according to claim 3, wherein the housing comprises means for attaching to a gripping tool of said truck.

5. The tool according to claim 1, wherein the opening of the housing is sized to attach to the access opening of the container, and the tool comprises means for attaching the opening of the housing to the opening of container.

6. The tool according to claim 1, wherein the opening of the housing is provided with a door and the housing is designed to sealingly enclose the robot when the door is closed in order to protect the robot from the surrounding environment.

7. The tool according to claim 1, wherein the tool comprises a dry ice producing unit arranged to produce dry ice and to provide the nozzle with the dry ice, and the dry ice producing unit is located inside the housing.

8. The tool according to claim 7, wherein the tool comprises a power unit for providing power to the robot, the actuating unit and to the dry ice producing unit, and the power unit is located inside the housing.

9. The tool according to claim 1, wherein the robot is an industrial robot having at least four rotational axes.

10. A system for cleaning an interior of a freight container of ISO type having an access opening for receiving goods, the system comprising:

a cleaning tool including a framework;

a robot movable connected to the framework and provided with a nozzle for supplying a cleaning medium; and an actuating unit arranged to move the robot between the framework and the interior of the container, wherein:

said cleaning medium is dry ice and the robot is adapted to clean the interior of the container by means of dry ice blasting; and the framework further includes a ventilation duct for transporting waste products originating from the dry ice cleaning from the container to the tool, the ventilation duct having an inlet arranged in an opening of the framework;

the system further comprises a truck adapted for gripping and carrying freight containers of ISO type;

the tool is portable unit; and the framework has a size and design that allows said truck to grip and carry the cleaning tool in order to move the cleaning tool to the container to be cleaned.

11. A tool for cleaning an interior of a freight container of ISO type having an access opening for receiving goods, the tool comprising:

a framework;

a robot movably connected to the framework and provided with a nozzle for supplying a dry ice cleaning medium;

an actuating unit arranged to move the robot between the framework and the interior of the container;

a dry ice producing unit located inside the framework, and arranged to produce the dry ice and to provide the nozzle with the dry ice; and a power unit located inside the framework and configured to providing power to the robot, the actuating unit and to the dry ice producing unit, wherein the power unit is arranged to produce power from a fossil fuel and emit waste gases that include carbon dioxide, and wherein the dry ice producing unit is configured to receive the waste gases from the power unit and reuse the carbon dioxide of the waste gases when producing the dry ice, wherein:

the tool is a portable unit;

the tool has a size and design that allows a truck adapted for gripping and carrying freight containers of ISO type to grip and carry the tool in order to move the tool to and from the container to be cleaned; and the robot and the nozzle are adapted to clean the interior of the container by means of dry ice blasting, and the framework comprises a housing enclosing the robot and the actuating unit, the housing having an opening for receiving the robot and the actuating unit is arranged to move the robot between an interior of the housing and the interior of the container when the opening of the housing is facing the opening of the container.

* * * * *

UNITED STATES PATENT AND TRADEMARK OFFICE

CERTIFICATE OF CORRECTION

PATENT NO. : 9,061,326 B2
APPLICATION NO. : 13/322824
DATED : June 23, 2015
INVENTOR(S) : Kerstin Eriksson et al.

It is certified that error appears in the above-identified patent and that said Letters Patent is hereby corrected as shown below:

In the claims,

Column 8, Line 61, Claim 5:

After "of the housing to the opening of"
Insert --the--

Column 9, Line 12, Claim 10:

After "a robot"
Delete "movable" and
Insert --movably--

Signed and Sealed this
Fifth Day of January, 2016

Michelle K. Lee

Michelle K. Lee
*Director of the United States Patent and Trademark Office*